United States Patent [19]

Milroy

[11] Patent Number: 4,801,783

[45] Date of Patent: Jan. 31, 1989

[54] CONNECTORS

[75] Inventor: James C. Milroy, Palo Alto, Calif.

[73] Assignee: Raychem Corporation, Menlo Park, Calif.

[21] Appl. No.: 59,702

[22] Filed: Jun. 8, 1987

[51] Int. Cl.[4] ..... H05B 3/08

[52] U.S. Cl. ..... 219/541; 219/553; 439/260

[58] Field of Search ..... 219/541, 539, 553, 528, 219/543, 548; 338/212; 439/245, 246, 247, 260

[56] References Cited

U.S. PATENT DOCUMENTS

| | | | |
|---|---|---|---|
| 3,042,892 | 7/1962 | Hayworth | 339/100 |
| 3,188,606 | 6/1965 | De Lyon et al. | 339/256 |
| 3,268,846 | 8/1966 | Morey | 338/212 |
| 4,058,704 | 11/1977 | Shimizu | 219/528 |
| 4,327,282 | 4/1982 | Nauerth | 219/541 |
| 4,419,569 | 12/1983 | Colten | 219/528 |
| 4,582,983 | 4/1986 | Midgley et al. | 219/539 |
| 4,593,181 | 6/1986 | Jensen et al. | 219/541 |
| 4,685,025 | 8/1987 | Carlomagno | 361/106 |
| 4,751,350 | 6/1988 | Eaton | 174/87 |

FOREIGN PATENT DOCUMENTS

| | | |
|---|---|---|
| 59-205705 | 11/1984 | Japan . |
| 60-49603 | 3/1985 | Japan . |

*Primary Examiner*—H. Broome
*Assistant Examiner*—M. M. Lateef
*Attorney, Agent, or Firm*—Timothy H. P. Richardson; Herbert G. Burkard

[57] ABSTRACT

A connector for self-regulating heat tapes in which a resistive element is sandwiched between laminar electrodes. The connector includes a cavity into which the heating tape is placed and within which the electrodes are contacted by respective contact members whose other ends contact a power lead or the electrodes of a similar heating tape. Preferably the contact members are metal strips which are elastically deformed when the heating strip is pushed into the connector and which are staggered within the connector.

20 Claims, 2 Drawing Sheets

CONNECTORS

BACKGROUND OF THE INVENTION

Field of the Invention

This invention relates to connectors for self-regulating tape heaters.

Introduction to the Invention

Self-regulating heaters of various kinds are known. Copending commonly assigned Application Ser. No. 818,846 the disclosure of which is incorporated herein by reference, described novel PTC conductive polymer compositions which can be of very high resistivity and which can, therefore, be used in heaters which comprise a thin layer of the PTC composition sandwiched between two metal foil electrodes, particularly such electrodes having a "microrough" surface adjacent the conductive polymer, as disclosed in copending commonly assigned Ser. Nos. 787,218 now U.S. Pat. No. 4,689,475, 818,844, and 864,930. Such heaters can be flexible and can be made in a wide variety of shapes including elongate thin tapes which are ideally suited for heating dwellings because they can be fixed unobtrusively to the structure of the dwelling, for example to a baseboard or under a carpet.

SUMMARY OF THE INVENTION

I have discovered a new type of connector which is very useful for connecting self-regulating heating tapes, including in particular heating tapes of the kind just described.

In one aspect, the present invention provides an assembly which comprises (1) an elongate self-regulating heating tape which has a substantially rectangular cross-section and which comprises (a) a laminar self-regulating resistive heating element having a first surface and an opposite second surface, (b) a first laminar electrode which has an inner surface and an outer surface, substantially the whole of the inner surface being in contact with the first surface of the heating element, (c) a second laminar electrode which has an inner surface and an outer surface, substantially the whole of the inner surface being in contact with the second surface of the heating element, and (d) an insulating jacket which surrounds the first and second electrodes and the heating element except at least one end of the tape, at which end the outer surfaces of the electrodes are exposed; and (2) a connector which comprises (a) a housing which is composed of an insulating material and which comprises a cavity enclosing said end of the heating tape comprising the exposed electrodes, (b) a first contact member which (i) is secured to the housing within the cavity, (ii) has a first contact surface which contacts the exposed surface of the first electrode, and (iii) has a second contact surface which is connectable to a further conductor, and (c) a second contact member which (i) is secured to the housing within the cavity, (ii) has a third contact surface which contacts the exposed surface of the second electrode, and (iii) has a fourth contact surface which is connectable to a further conductor.

A connector as defined above is itself novel and forms part of the present invention.

BRIEF DESCRIPTION OF THE DRAWING

The invention is illustrated in the accompanying drawing, in which

FIG. 1 is a plan view of an assembly of the invention comprising two heating tapes connected at right angles by a connector;

DETAILED DESCRIPTION OF THE INVENTION

Figure 1:
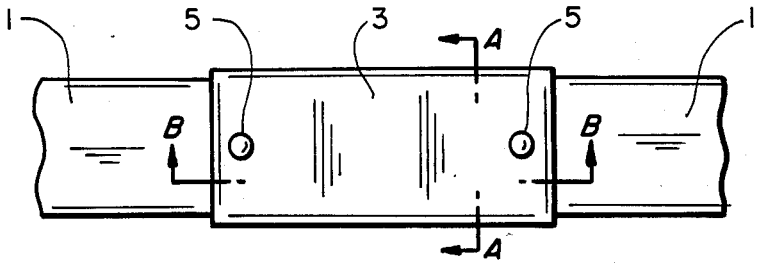
FIG. 1 is a side view of an assembly of the invention comprising two heating tapes connected in line by a connector.

The invention can be used to connect two or more heating tapes, which may be the same or different, in any desired spatial configuration, but is most frequently used to connect two heating tapes which have the same cross-section, either in line or at an angle, e.g. a right angle, or to connect one or two heating tapes to an electrical lead from a power supply. It will be observed that the connector preserves the polarity of incoming power. Because the heating tape is self-regulating, it will generate heat, but not excessive heat, within the connector, so that there will not be a gap in the heating. The novel connectors are particularly useful when each of the contact members comprises a metal strip or other laminar member which is maintained in contact with one of the electrodes by resilient force. Preferably such resilient force is provided by elastic deformation of the contact member itself, and preferably the contact members are such that the desired contacts can be made simply by pushing the end of the heater into the housing. The outer surfaces of the electrodes must of course be exposed by removal of the insulating jacket in some way, for example by unwrapping an insulating tape wrapped around the electrodes and heating element, but the electrodes are not separated from the heating element. Preferably a part of the heater within the connector retains its insulating jacket, so as to ensure a continuous insulating cover over the heater. Preferably the connector and exposed length of heater are such that when the end of the heater is pushed into the connector, the housing completely covers the exposed surfaces of the electrodes before they contact the contact members. It is also preferred that the contact members are such that they do not touch each other in the absence of the heating tape; preferably they are staggered to ensure such separation.

The dimensions of the connector are preferably such that the heating tape fits snugly into it. Thus if the heating tape is of rectangular cross-section, as it usually will be, the cavity of the connector is preferably also of rectangular cross-section. The length of the connector may be for example 1 to 3 inches. The heating tape is usually at least 12 inches long, e.g. 1–8 ft long, and has a width which is preferably 0.25 to 3 inches, particularly 0.5 to 2 inches, and a thickness which is preferably 0.03 to 0.2 inch, particularly 0.05 to 0.15 inch. The resistive heating element is preferably composed of a conductive polymer which exhibits PTC behavior, particularly one of the kind described in the copending applications incorporated by reference herein. The material of the heating element preferably has a resistivity at 23° C. of 50,000 to 1,000,000 ohm.cm, particularly 100,000 to 350,000 ohm.cm. The thickness of the resistive heating element is preferably 0.002 to 0.2 inch, particularly 0.01 to 0.1 inch.

If desired, the heating tape can be secured within the connector to prevent accidental disconnection, for example by means of an insulating locking member which passes through an opening in the connector and through the heating tape.

Figure 2:
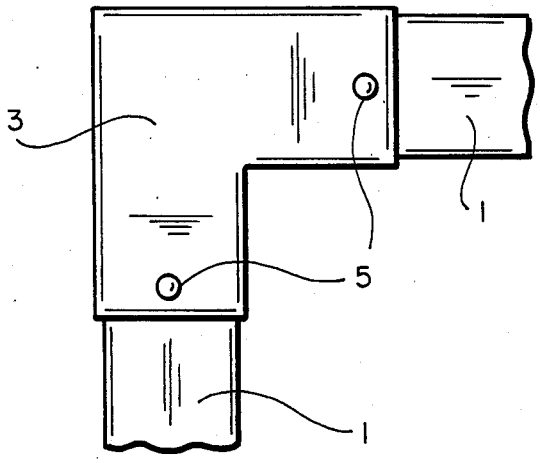
Figure 3:
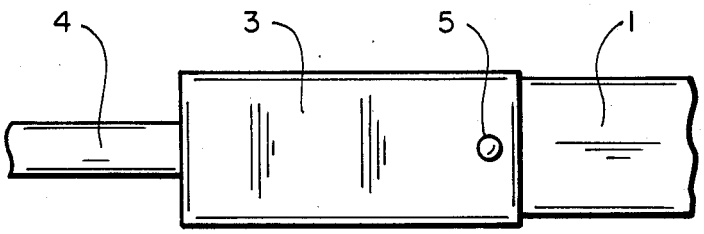
FIG. 3 is a side view of an assembly of the invention comprising a heating tape connected in line with an electrical lead comprising two insulated conductors covered by an insulating jacket.
Figure 4:
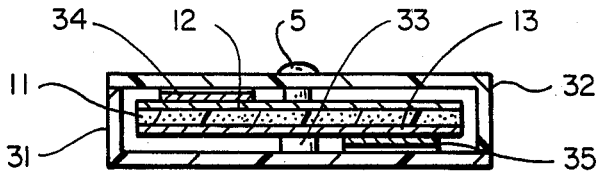
FIG. 4 is a cross-section on line AA of FIG. 1.
Figure 5:
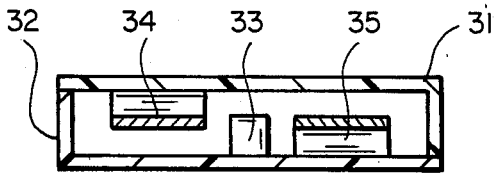
FIG. 5 is a cross-section of the connector only, i.e. before insertion of the heating tape, corresponding to FIG. 4.
Figure 6:
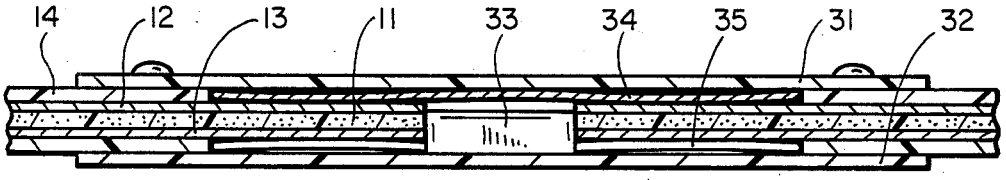
FIG. 6 is a cross-section on line BB of FIG. 1.
Figure 7:
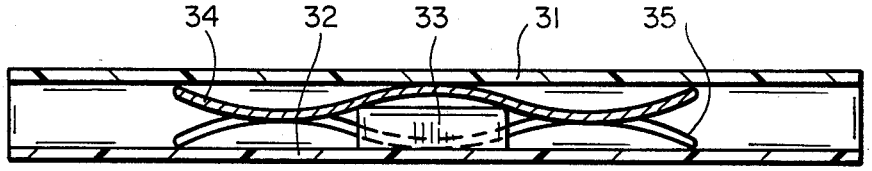
FIG. 7 is a cross-section of the connector only, i.e. before insertion of the heating tape, corresponding to FIG. 6.

Referring now to the drawing, each of FIGS. 1 and 2 shows self-regulating heating tapes, each of which is indicated by 1, which are joined through a connector 3 which is straight in FIG. 1 and right-angled in FIG. 2. FIG. 3 shows a self-regulating heater 1 which is joined in line by a connector 3 to an electrical lead 4 comprising two insulated conductors covered by an insulating jacket. As shown in the cross-sectional views in FIGS. 4 to 7, the self-regulating heating tapes comprise a laminar resistive heating element 11 which is composed of a melt-extruded PTC conductive polymer which is sandwiched between metal foil electrodes 12 and 13. The heating element and electrodes are covered by an insulating jacket 14 which is stripped from the end of the heating tape to expose the electrodes. The connector 3 comprises a housing made up from two insulating members 31 and 32 which define a cavity having an insulating stop member 33 in the middle thereof. Fixed respectively to the members 31,32 (by means not shown) are metal strips 34,35 which have a double arcuate shape as shown in FIG. 7, which are deformed when heating tapes are pushed into the cavity so that they are maintained in contact with the respective electrodes by resilient force. The heating strips are maintained in place by insulating members 5 which pass through the housing and the heater and can for example be fused to the housing.

I claim:

1. An assembly which comprises (1) an elongate self-regulating heating tape which has a substantially rectangular cross-section and which comprises
  (a) a laminar self-regulating resistive heating element having a first surface and an opposite second surface,
  (b) a first laminar electrode which has an inner surface and an outer surface, substantially the whole of the inner surface being in contact with the first surface of the heating element,
  (c) a second laminar electrode which has an inner surface and an outer surface, substantially the whole of the inner surface being in contact with the second surface of the heating element, and
  (d) an insulating jacket which surrounds the first and second electrodes and the heating element except at least one end of the tape, at which end the outer surfaces of the electrodes are exposed; and (2) a connector which comprises
  (a) a housing which is composed of an insulating material and which comprises a cavity enclosing said end of the heating tape comprising the exposed electrodes,
  (b) a first contact member which
    (i) is secured to the housing within the cavity,
    (ii) has a first contact surface which contacts the exposed surface of the first electrode, and
    (iii) has a second contact surface which is connectable to a further conductor, and
  (c) a second contact member which
    (i) is secured to the housing within the cavity,
    (ii) has a third contact surface which contacts the exposed surface of the second electrode, and
    (iii) has a fourth contact surface which is connectable to a further conductor.

2. An assembly according to claim 1 wherein each of the contact members comprises a laminar member which is maintained in contact with the respective electrode by resilient force.

3. An assembly according to claim 2 wherein the contact members are such that if the heating tape is removed from the connector, the contact members do not contact each other.

4. An assembly according to claim 3 wherein the contact between the contact members and the exposed electrodes has been achieved by pushing the end of the heating tape into the housing.

5. An assembly according to claim 4 wherein the housing is such that, when the end of the heating tape is pushed into the connector, the housing completely covers the exposed surfaces of the electrodes before they contact the contact members.

6. An assembly according to claim 4 wherein each of the contact members comprises an elastically deformed metal strip.

7. An assembly according to claim 1 wherein the heating tape is 0.25 to 3 inches wide, 0.03 to 0.2 inch thick, and at least 12 inches long.

8. An assembly according to claim 7 wherein the first electrode substantially covers the first surface of the heating element, the second electrode substantially covers the second surface of the heating element, and the resistive heating tape consists essentially of a conductive polymer composition which exhibits PTC behavior and which has a resistivity at 23° C. of 50,000 to 1,000,000 ohm.cm.

9. An assembly according to claim 8 wherein the resistive heating element is 0.002 to 0.2 inch thick.

10. An assembly according to claim 6 wherein the cavity in the housing has a substantially rectangular cross section and the contact members are strips of metal which are secured to opposite surfaces of the cavity in a staggered formation.

11. An assembly according to claim 1 which comprises a second heating tape which is substantially the same as the first heating tape, and wherein the housing comprises a cavity which encloses the exposed electrodes of the second heating tape and within which the exposed electrodes of the second heating tape make respective contact with the second contact surface of the first contact member and the fourth contact surface of the second contact member.

12. An assembly according to claim 1 which comprises an insulated electrical lead comprising first and second conductors which make respective contact with the second contact surface of the first contact member and the fourth contact surface of the second contact member.

13. An assembly according to claim 1 which comprises a locking member which is composed of an insulating material and which passes through an opening in the connector and through the heating tape.

14. A connector for use with an elongate self-regulating heating tape which has a substantially rectangular cross-section and which comprises (a) a laminar self-regulating resistive heating element having a first surface and an opposite second surface, (b) a first laminar electrode which substantially covers the first surface of the heating element, and which has an inner surface and an outer surface, substantially the whole of the inner surface being in contact with the first surface of the heating element, (c) a second laminar electrode which substantially covers the second surface of the heating element, and which has an inner surface and an outer surface, substantially the whole of the inner surface being in contact with the second surface of the heating element, and (d) an insulating jacket which surrounds the first and second electrodes and the heating element except at at least one end of the tape, at which end the outer surfaces of the electrodes are exposed;

said connector comprising (a) a housing which is composed of an insulating material and which comprises a cavity adapted to enclose the end of a said heating tape comprising exposed electrodes, (b) a first contact member which (i) is secured to the housing within the cavity, (ii) has a first contact surface which, when the end of a said heating tape comprising exposed electrodes is enclosed within the cavity, contacts the exposed surface of the first electrode, and (iii) has a second contact surface which is connectable to a further conductor, and (c) a second contact member which secured to the housing within the cavity, (ii) has a third contact surface which, when the end of a said heating tape comprising exposed electrodes is enclosed within the cavity, contacts the exposed surface of the second electrode, and (iii) has a fourth contact surface which is connectable to a further conductor.

15. A connector according to claim 14 wherein each of the contact members comprises a laminar member which is resiliently biased so that, when the end of a said heating tape comprising exposed electrodes is enclosed within the cavity, the contact member is maintained in contact with the respective electrode by resilient force.

16. A connector according to claim 15 wherein the contact members do not contact each other in the absence of the heating tape.

17. A connector according to claim 16 wherein the end of a said heating tape comprising exposed electrodes can be pushed into the cavity and the exposed electrodes can thus be brought into contact with respective contact members.

18. A connector according to claim 17 wherein the cavity in the housing has a substantially rectangular cross section and the contact members are strips of metal which are secured to opposite surfaces of the cavity in a staggered formation.

19. A connector according to claim 14 wherein the housing comprises a cavity within which lie the second contact surface of the first contact member and the fourth contact surface of the second contact member, so that the end of a said heating tape having exposed electrodes can be pushed into the cavity and the exposed electrodes can thus be brought into contact with the second and fourth contact surfaces respectively.

20. A connector according to claim 14 which comprises an insulated electrical lead comprising first and second conductors which make respective contact with the second contact surface of the first contact member and the fourth contact surface of the second contact member.

* * * * *

UNITED STATES PATENT AND TRADEMARK OFFICE

CERTIFICATE OF CORRECTION

PATENT NO. : 4,801,783

DATED : January 31, 1989

INVENTOR(S): James C. Milroy

It is certified that error appears in the above-identified patent and that said Letters Patent is hereby corrected as shown below:

In Column 1, line 51, after "except" insert --at--.

In Claim 1, line 18, after "except" insert --at--.

In Claim 14, Col. 6, line 1, after "which" delete "secured to the housing within the cavity" and insert --(i) is secured to the housing within the cavity--.

Signed and Sealed this

Fourteenth Day of August, 1990

*Attest:*

HARRY F. MANBECK, JR.

*Attesting Officer*

*Commissioner of Patents and Trademarks*